US007482936B2

(12) United States Patent
Bolling

(10) Patent No.: US 7,482,936 B2
(45) **Date of Patent: *Jan. 27, 2009**

(54) HAND CLEANLINESS

(75) Inventor: Steven F Bolling, Ann Arbor, MI (US)

(73) Assignee: BioVigil, LLC, Santa Rosa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/876,267

(22) Filed: Oct. 22, 2007

(65) Prior Publication Data

US 2008/0042854 A1 Feb. 21, 2008

(51) Int. Cl.
*G08B 23/00* (2006.01)

(52) U.S. Cl. ..... 340/573.1; 340/309.7; 340/539.12

(58) Field of Classification Search ..... 340/573.1, 340/309.7, 539.12, 286.09, 329, 286.07; 368/10

See application file for complete search history.

(56) References Cited

U.S. PATENT DOCUMENTS 4,354,292 A 10/1982 Telestad et al.
4,370,983 A 2/1983 Lichtenstein
4,706,493 A 11/1987 Chang et al.
5,202,666 A * 4/1993 Knippscheer ..... 340/573.1
5,366,896 A 11/1994 Margrey et al.
5,373,852 A 12/1994 Harrison et al.
5,412,816 A 5/1995 Paterson et al.
5,428,213 A 6/1995 Kurihara
5,441,047 A 8/1995 David et al.
5,544,649 A 8/1996 David et al.
5,606,159 A 2/1997 Kurihara
5,610,589 A * 3/1997 Evans et al. ..... 340/573.1
5,670,945 A 9/1997 Applonie
5,685,262 A 11/1997 Stevenson (Continued)

FOREIGN PATENT DOCUMENTS

EP 1 455 177 9/2004

(Continued)

OTHER PUBLICATIONS

Katz, "Hand Washing And Hand Disinfection: More Than Your Mother Taught You", Anethesiology Clinics of North America, 22 (2004) pp. 457-471.

(Continued)

*Primary Examiner*—Jeff Hofsass
*Assistant Examiner*—Anne V Lai
(74) *Attorney, Agent, or Firm*—Fish & Richardson P.C.

(57) ABSTRACT

An electronic sensor is configured to be carried by a person and to be used by the person to detect a cleanliness state of the person's hands. A single unit includes the electronic sensor and (a) a device to provide an indication of the cleanliness state of the person's hands and/or (b) a device to identify the person. A circuit that is configured to control how long after a cleanliness state of a person's hands has been determined to be clean, the state is presumed no longer to be clean. A badge that includes indicia identifying a person who carries the badge, a sensor to be used to detect a cleanliness state of the person's hands, and a visible indicator to indicate to other people the cleanliness state of the person's hands can be used in combination.

13 Claims, 3 Drawing Sheets

U.S. PATENT DOCUMENTS

Figure 1:
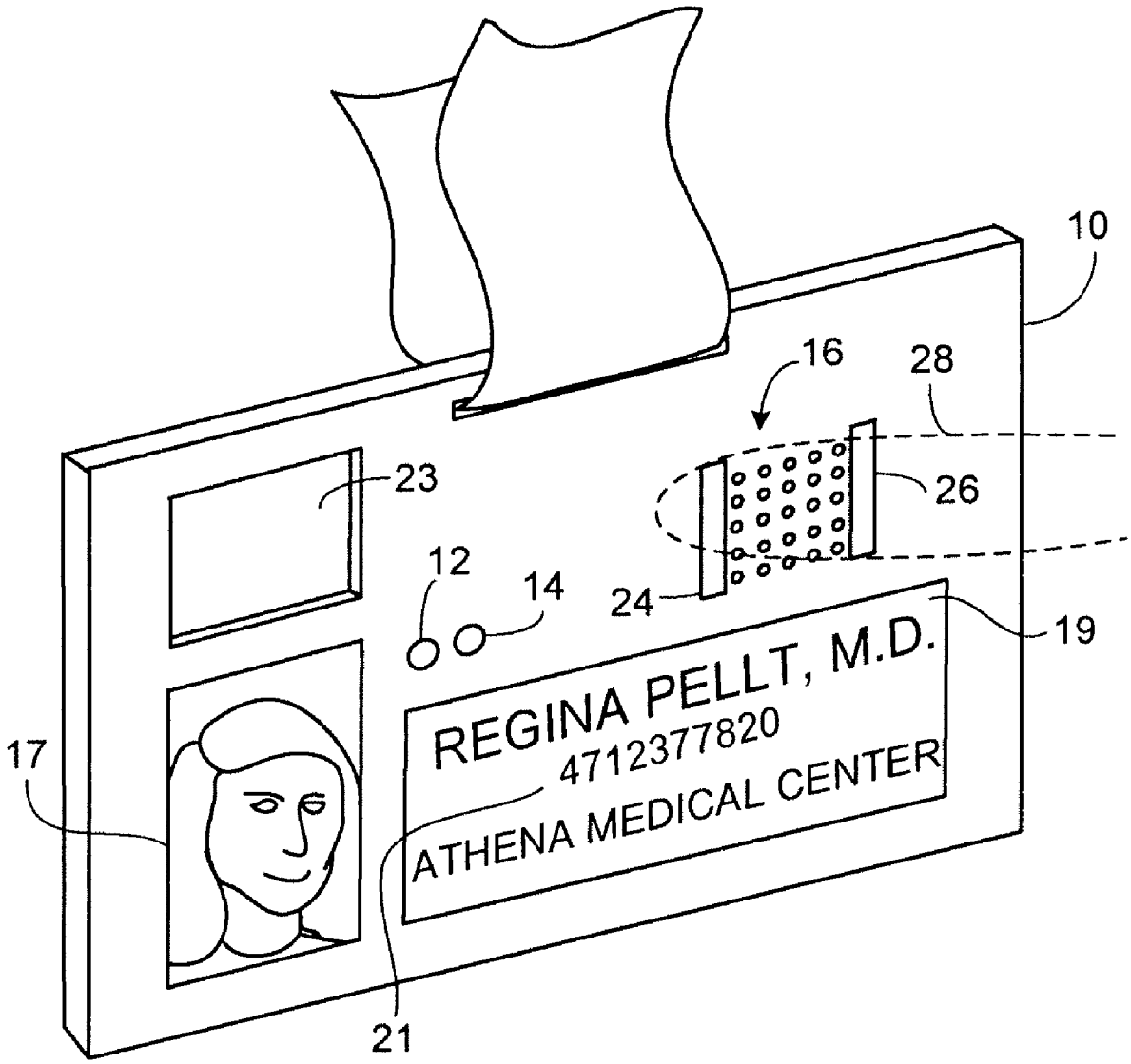

| | | | | |
|---|---|---|---|---|
| 5,771,925 | A | 6/1998 | Lewandowski | |
| 5,793,653 | A | 8/1998 | Segal | |
| 5,808,553 | A | 9/1998 | Cunningham | |
| 5,812,059 | A | 9/1998 | Shaw et al. | |
| 5,870,015 | A | 2/1999 | Hinkel | |
| 5,900,067 | A | 5/1999 | Jones | |
| 5,900,801 | A | 5/1999 | Heagle et al. | |
| 5,914,247 | A | 6/1999 | Casey et al. | |
| 5,939,974 | A | 8/1999 | Heagle et al. | |
| 5,943,713 | A | 8/1999 | Paterson et al. | |
| 5,945,910 | A | 8/1999 | Gorra | |
| 5,952,924 | A * | 9/1999 | Evans et al. | 340/573.1 |
| 5,954,069 | A | 9/1999 | Foster | |
| 5,966,753 | A | 10/1999 | Gauthier et al. | |
| 5,992,430 | A | 11/1999 | Chardack et al. | |
| 6,001,127 | A | 12/1999 | Schoon et al. | |
| 6,009,333 | A | 12/1999 | Chaco | |
| 6,029,293 | A | 2/2000 | Patterson et al. | |
| 6,029,600 | A | 2/2000 | Davis | |
| 6,032,071 | A | 2/2000 | Binder | |
| 6,038,331 | A | 3/2000 | Johnson | |
| 6,125,482 | A | 10/2000 | Foster | |
| 6,131,587 | A | 10/2000 | Chardack et al. | |
| 6,190,326 | B1 | 2/2001 | McKinnon et al. | |
| 6,236,317 | B1 * | 5/2001 | Cohen et al. | 340/573.1 |
| 6,236,953 | B1 | 5/2001 | Segal | |
| 6,245,206 | B1 | 6/2001 | Anderson et al. | |
| 6,246,330 | B1 | 6/2001 | Nielsen | |
| 6,278,372 | B1 * | 8/2001 | Velasco et al. | 340/573.1 |
| 6,347,724 | B1 | 2/2002 | Chen et al. | |
| 6,355,030 | B1 | 3/2002 | Aldrich et al. | |
| 6,375,038 | B1 | 4/2002 | Daansen et al. | |
| 6,392,546 | B1 * | 5/2002 | Smith | 340/573.1 |
| 6,404,837 | B1 | 6/2002 | Thompson et al. | |
| 6,417,773 | B1 | 7/2002 | Vlahos et al. | |
| 6,426,225 | B1 | 7/2002 | Lewis et al. | |
| 6,426,701 | B1 * | 7/2002 | Levy et al. | 340/573.1 |
| 6,431,400 | B1 | 8/2002 | O'Maley et al. | |
| 6,468,800 | B1 | 10/2002 | Stylli et al. | |
| 6,471,087 | B1 | 10/2002 | Shusterman | |
| 6,542,568 | B1 | 4/2003 | Howes, Jr. et al. | |
| 6,572,564 | B2 | 6/2003 | Ito et al. | |
| 6,592,822 | B1 | 7/2003 | Chandler | |
| 6,605,038 | B1 | 8/2003 | Teller et al. | |
| 6,633,772 | B2 | 10/2003 | Ford et al. | |
| 6,687,190 | B2 | 2/2004 | Momich et al. | |
| 6,702,826 | B2 | 3/2004 | Liddicoat et al. | |
| 6,727,818 | B1 | 4/2004 | Wildman et al. | |
| 6,748,281 | B2 | 6/2004 | Alsio | |
| 6,757,898 | B1 | 6/2004 | Ilsen et al. | |
| 6,776,791 | B1 | 8/2004 | Stallings et al. | |
| 6,790,231 | B2 | 9/2004 | Liddicoat et al. | |
| 6,814,816 | B2 | 11/2004 | Achar et al. | |
| 6,847,913 | B2 | 1/2005 | Wigley et al. | |
| 6,867,698 | B2 | 3/2005 | Herbert et al. | |
| 6,882,273 | B2 | 4/2005 | Kano | |
| 6,882,278 | B2 | 4/2005 | Winnings et al. | |
| 6,883,563 | B2 | 4/2005 | Smith | |
| 6,895,338 | B2 | 5/2005 | Hsuing et al. | |
| 6,913,608 | B2 | 7/2005 | Liddicoat et al. | |
| 6,929,607 | B2 | 8/2005 | Lipman | |
| 6,942,694 | B2 | 9/2005 | Liddicoat et al. | |
| 6,943,678 | B2 | 9/2005 | Muirhead | |
| 6,964,638 | B2 | 11/2005 | Theodoracopulos et al. | |
| 6,965,312 | B2 | 11/2005 | Lerg | |
| 6,967,576 | B2 | 11/2005 | Hayes et al. | |
| 6,975,231 | B2 | 12/2005 | Lane et al. | |
| 7,007,698 | B2 | 3/2006 | Thornton | |
| 7,015,816 | B2 | 3/2006 | Wildman et al. | |
| 7,024,236 | B2 | 4/2006 | Ford et al. | |
| 7,034,677 | B2 * | 4/2006 | Steinthal et al. | 340/539.12 |
| 7,034,691 | B1 | 4/2006 | Rapaport et al. | |
| 7,045,673 | B1 | 5/2006 | Batich et al. | |
| 7,063,722 | B2 | 6/2006 | Marquez | |
| 7,074,183 | B2 | 7/2006 | Castellanos | |
| 7,081,131 | B2 | 7/2006 | Thornton | |
| 7,087,015 | B1 | 8/2006 | Comrie et al. | |
| 7,095,501 | B2 | 8/2006 | Lambert et al. | |
| 7,098,793 | B2 | 8/2006 | Chung | |
| 7,107,631 | B2 | 9/2006 | Lang et al. | |
| 7,122,005 | B2 | 10/2006 | Shusterman | |
| 7,132,940 | B2 | 11/2006 | Ehben et al. | |
| 7,191,097 | B1 | 3/2007 | Lee et al. | |
| 7,228,874 | B2 | 6/2007 | Bolderheij et al. | |
| 7,236,097 | B1 | 6/2007 | Cunningham | |
| 7,242,306 | B2 | 7/2007 | Wildman et al. | |
| 7,242,307 | B1 | 7/2007 | LeBlond et al. | |
| 7,267,798 | B2 | 9/2007 | Chandler | |
| 7,271,728 | B2 | 9/2007 | Taylor et al. | |
| 7,286,057 | B2 | 10/2007 | Bolling | |
| 7,293,645 | B2 * | 11/2007 | Harper et al. | 206/205 |
| 7,375,640 | B1 * | 5/2008 | Plost | 340/573.1 |
| 2002/0019586 | A1 | 2/2002 | Teller et al. | |
| 2002/0082177 | A1 | 6/2002 | Tabaac | |
| 2002/0095073 | A1 | 7/2002 | Jacobs et al. | |
| 2002/0132214 | A1 | 9/2002 | Mattson et al. | |
| 2003/0019536 | A1 | 1/2003 | Smith | |
| 2003/0026549 | A1 | 2/2003 | Ellis et al. | |
| 2003/0030562 | A1 | 2/2003 | Lane et al. | |
| 2003/0130567 | A1 | 7/2003 | Mault et al. | |
| 2003/0147925 | A1 | 8/2003 | Sawan et al. | |
| 2003/0179224 | A1 | 9/2003 | Alsio | |
| 2003/0220215 | A1 | 11/2003 | Manske | |
| 2004/0034289 | A1 | 2/2004 | Teller et al. | |
| 2004/0067544 | A1 | 4/2004 | Vogel et al. | |
| 2004/0090333 | A1 | 5/2004 | Wildman et al. | |
| 2004/0092965 | A1 | 5/2004 | Parihar | |
| 2004/0135684 | A1 | 7/2004 | Steinthal et al. | |
| 2004/0148019 | A1 | 7/2004 | Vidlund et al. | |
| 2004/0148020 | A1 | 7/2004 | Vidlund et al. | |
| 2004/0150527 | A1 | 8/2004 | Harper et al. | |
| 2004/0155772 | A1 | 8/2004 | Medema et al. | |
| 2004/0172063 | A1 | 9/2004 | Li et al. | |
| 2004/0186565 | A1 | 9/2004 | Schreck | |
| 2004/0193261 | A1 | 9/2004 | Berreklouw | |
| 2004/0243104 | A1 | 12/2004 | Seddon | |
| 2004/0243230 | A1 | 12/2004 | Navia et al. | |
| 2005/0004665 | A1 | 1/2005 | Aklog | |
| 2005/0004668 | A1 | 1/2005 | Aklog et al. | |
| 2005/0006559 | A1 | 1/2005 | Smith | |
| 2005/0035862 | A1 | 2/2005 | Wildman et al. | |
| 2005/0049157 | A1 | 3/2005 | MacDonald et al. | |
| 2005/0079637 | A1 | 4/2005 | Wilhelm et al. | |
| 2005/0088299 | A1 | 4/2005 | Bandy et al. | |
| 2005/0090414 | A1 | 4/2005 | Rich | |
| 2005/0134465 | A1 | 6/2005 | Rice et al. | |
| 2005/0191326 | A1 | 9/2005 | Melker | |
| 2005/0227880 | A1 | 10/2005 | Shiloach et al. | |
| 2005/0231373 | A1 | 10/2005 | Lynn et al. | |
| 2005/0233918 | A1 | 10/2005 | Rich | |
| 2005/0233919 | A1 | 10/2005 | Rich | |
| 2006/0025855 | A1 | 2/2006 | Lashinski et al. | |
| 2006/0067545 | A1 | 3/2006 | Lewis et al. | |
| 2006/0071799 | A1 | 4/2006 | Verdiramo | |
| 2006/0111620 | A1 | 5/2006 | Squilla et al. | |
| 2006/0132316 | A1 | 6/2006 | Wildman et al. | |
| 2006/0184240 | A1 | 8/2006 | Jimenez et al. | |
| 2006/0184241 | A1 | 8/2006 | Marquez | |
| 2006/0214000 | A1 | 9/2006 | Lapstun et al. | |
| 2006/0240397 | A1 | 10/2006 | Lynn et al. | |
| 2006/0272361 | A1 | 12/2006 | Snodgrass | |
| 2006/0273915 | A1 | 12/2006 | Snodgrass | |
| 2007/0005129 | A1 | 1/2007 | Damm et al. | |
| 2007/0008149 | A1 | 1/2007 | Bolling | |

| | | | | |
|---|---|---|---|---|
| 2007/0015552 | A1 | 1/2007 | Bolling | |
| 2007/0080801 | A1 | 4/2007 | Weismiller et al. | |
| 2008/0031838 | A1 | 2/2008 | Bolling | |
| 2008/0246599 | A1 * | 10/2008 | Hufton et al. | 340/529 |

FOREIGN PATENT DOCUMENTS

| | | | |
|---|---|---|---|
| EP | 1 480 413 | | 11/2004 |
| EP | 1 510 987 | | 3/2005 |
| EP | 1 095 190 | | 4/2005 |
| EP | 1 555 351 | | 7/2005 |
| FR | 2 805 162 | | 8/2001 |
| WO | WO 93/15690 | | 8/1993 |
| WO | WO 97/12565 | | 4/1997 |
| WO | WO 97/20524 | | 6/1997 |
| WO | WO 98/24386 | | 6/1998 |
| WO | WO 99/29269 | | 6/1999 |
| WO | WO 99/49816 | | 10/1999 |
| WO | WO 99/66138 | | 12/1999 |
| WO | WO 00/44311 | | 8/2000 |
| WO | WO 00/62715 | | 10/2000 |
| WO | WO 01/89440 | | 11/2001 |
| WO | WO 02/59701 | A1 | 1/2002 |
| WO | WO 03/080150 | | 10/2003 |
| WO | WO 03/105670 | | 12/2003 |
| WO | WO 03/105730 | | 12/2003 |
| WO | WO 2004/014282 | | 2/2004 |
| WO | WO 2004/030569 | | 4/2004 |
| WO | WO 2004/031717 | | 4/2004 |
| WO | WO 2004/032717 | | 4/2004 |
| WO | WO 2004/073498 | | 9/2004 |
| WO | WO 2004/090760 | | 10/2004 |
| WO | WO 2004/090761 | | 10/2004 |
| WO | WO 2004/090796 | | 10/2004 |
| WO | WO 2004/090798 | | 10/2004 |
| WO | WO 2004/090803 | | 10/2004 |
| WO | WO 2004/103223 | | 12/2004 |
| WO | WO 2005/002424 | | 1/2005 |
| WO | WO 2005/007037 | | 1/2005 |
| WO | WO 2005/025963 | | 3/2005 |
| WO | WO 2005/046488 | | 5/2005 |
| WO | WO 2005/055046 | | 6/2005 |
| WO | WO 2006/086434 | | 8/2006 |

OTHER PUBLICATIONS

Patent Prior Art Search Results (US Only) (188 pages) Mar. 4, 2005.
Patent Keyword Search Results (91 pages) Mar. 10, 2005.
Cites and Abstracts from Search Results (12 pages) Jun. 17, 2005.
Figaro USA Inc., Technical Information for TGS2620, pp. 1-11, Rev. Oct. 2000.
Search Results, Cites and Abstracts, Oct. 14, 2005.
Search Results, Patent Keyword Search, Mar. 10, 2005.
Search Results, Patent Prior Art Search (US only), Mar. 4, 2005.
International Search Report for International Application No. PCT/US06/23204 dated May 8, 2007.
U.S. Patent Prior Art Search By Assignee, "Ultraclenz Engineering Group", May 16, 2006, pp. 1-3.
U.S. Search Results, Cites and Abstracts From Accession Number Retrieval, Mar. 11, 2005, pp. 1-12.
WIPO—Copy of PCT International Search Report, Nov. 30, 2007.
Berry et al., "The Business Case for Better Buildings" *Front Health Service Management*, 1-29 (2004).
Buergy et al., "Wearable Computers: An Interface between Humans and Smart Infrastructure Systems" *Carnegie Mellon University*, 1-13 (2002).
Dunn et al., "Recommended Standards for Newborn ICU Design" *Report of the Sixth Census Conference on Newborn ICU Design*, Orlando, Florida, Jan. 25-27, 2006.
Dunn et al., "Recommended Standards for Newborn ICU Design" *Report of the Sixth Census Conference on Newborn ICU Design*, Clearwater Beach, Florida, Feb. 1, 2007.
Echt et al., "Automated Abrasive Blasting Equipment for Use on Steel Structures" Taylor and Francis Ltd. Pub., Applied Occupation and Environmental Hygiene, vol. 15, No. 10, Oct. 2000.
International Search Report for International Application No. PCT/US07/72625 dated Dec. 18, 2007.
http://www.bbraunusa.com/pe/pe05a.html.
http://bostonscientific.com/med_specialty/deviceDetail.jsp.
www.implementology.org.pf.
International Search Report, PCT, dated Jul. 1, 2008 (13 pages).

* cited by examiner

HAND CLEANLINESS

CROSS-REFERENCE TO RELATED APPLICATION

Pursuant to 35 U.S.C. § 120, this application claims the benefit of prior U.S. application Ser. No. 11/157,094, filed Jun. 20, 2005, now U.S. Pat. No. 7,286,057. The contents of the prior application is incorporated herein by reference in its entirety.

BACKGROUND

This description relates to hand cleanliness.

Health care workers, food handlers, and others ought to clean their hands frequently and thoroughly, but they often don't. Better hand cleaning habits can be promoted by governmental regulations, company rules, social pressure, and technology. Techniques that have been proposed for improving cleaning habits include the use of special cleaning agents as well as mechanisms and electronic devices to regulate, monitor, and report on how frequently and how effectively people clean their hands.

SUMMARY

In general, in one aspect, the invention features an electronic sensor configured to be carried by a person and to be used by the person to detect a cleanliness state of the person's hands.

Implementations may include one or more of the following features. There is also a device configured (a) to identify the person, (b) to be associated with the electronic sensor, and (c) to be carried by the person. There is also a device configured to be associated with the electronic sensor and to provide an indication of the cleanliness state of the person's hands. The indicating device is configured to be carried by the person, and the indicating device and the sensor together are capable of detecting a cleanliness state of the person's hands and providing an indicator of the cleanliness state, without requiring cooperation between the apparatus and any device external to the apparatus. There is also a circuit to control how long after the state of the person's hands has determined to be clean, the state is presumed no longer to be clean.

In general, in another aspect, the invention features a single unit that includes an electronic sensor to be used by a person to detect a cleanliness state of the person's hands, and a device to provide an indication of the cleanliness state of the person's hands.

In general, in another aspect, the invention features a single unit that includes an electronic sensor to be used by a person to detect a cleanliness state of the person's hands, and a device to identify the person.

In general, in another aspect, the invention features a circuit that is configured to control how long after a cleanliness state of a person's hands has been determined to be clean, the state is presumed no longer to be clean.

Implementations may include one or more of the following features. The electronic sensor is configured to sense a presence or absence of a material indicative of the cleanliness state, for example, a vapor or alcohol. The cleanliness state comprises a disinfection state. The identification device comprises a badge. The identification device and the sensor are part of one unit. The electronic sensor, the identification device, and the indication device are part of one unit. The unit is configured to be worn by the person. The indication device comprises a visible indicator. The circuit comprises a countdown timer that is triggered in connection with the cleanliness state being determined to be clean. The circuit is part of the unit.

In general, in another aspect, the invention features a badge that includes indicia identifying a person who carries the badge, a sensor to be used to detect a cleanliness state of the person's hands, and a visible indicator to indicate to other people the cleanliness state of the person's hands.

In general, in another aspect, the invention features a person using an electronic sensor carried by the person to detect a cleanliness state of the person's hands.

In general, in another aspect, the invention features issuing a signal from a circuit to indicate how long after a state of a person's hands has been determined to be clean, the state is presumed no longer to be clean.

DETAILED DESCRIPTION

FIG. 1 is a perspective view of a badge.

Figure 2:
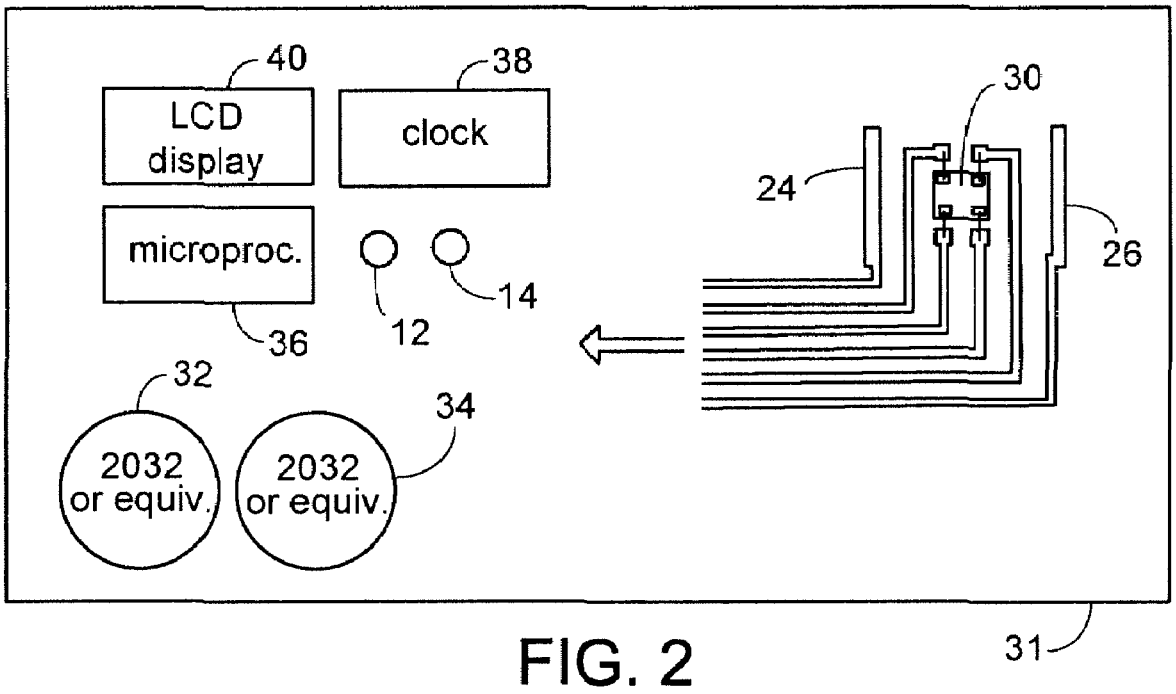
Figure 3:
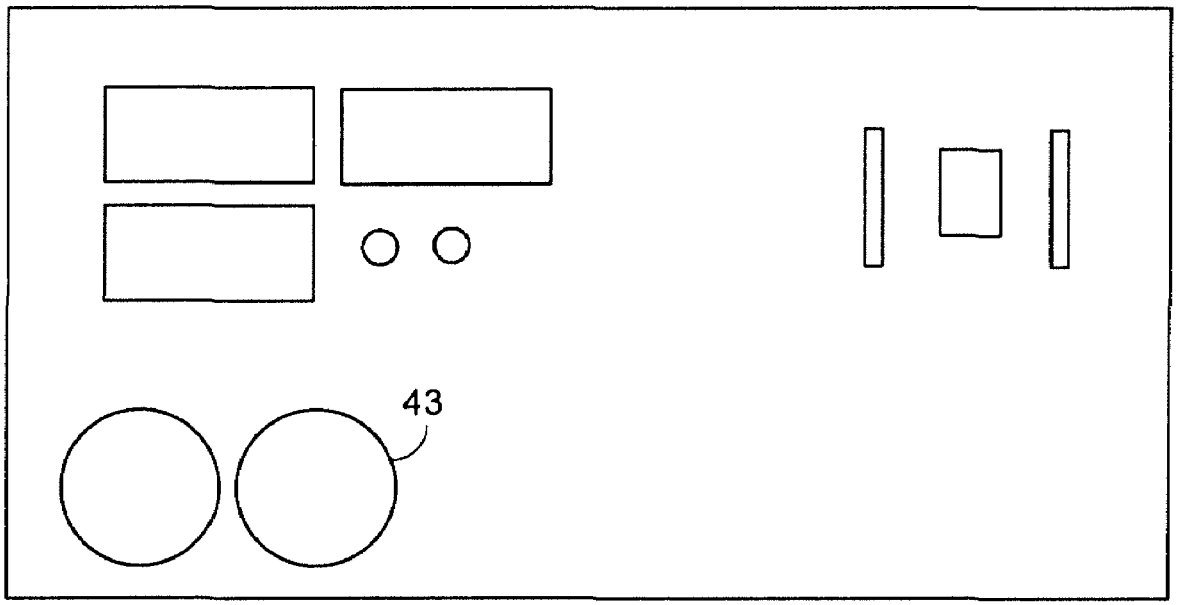
Figure 4:
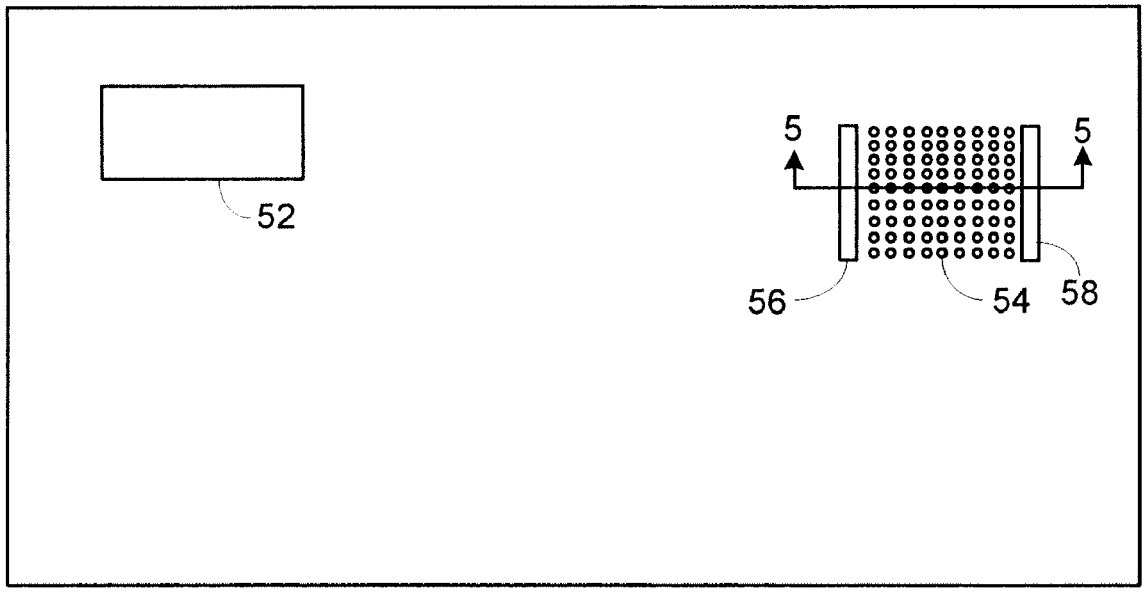

FIGS. 2, 3, and 4 are schematic plan views of three layers of the badge.

Figure 5:
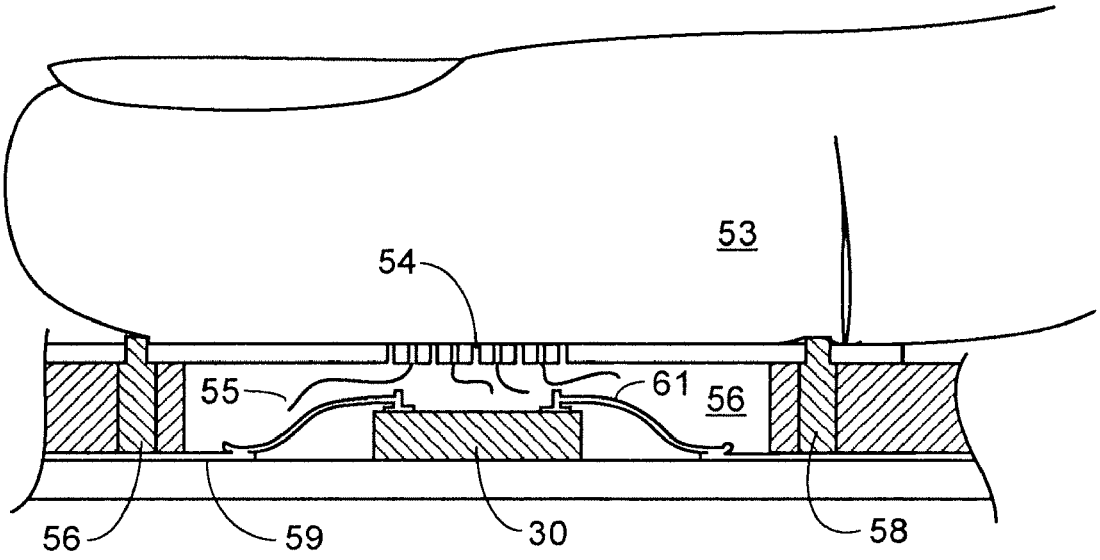

FIG. 5 is a sectional side view of a chamber at 5-5 in FIG. 4.

As shown in FIG. 1, in some examples, an identification badge 10 worn by a doctor has red and green lights 12, 14, that indicate that her hands are likely to be respectively in a clean (e.g., disinfected, green light) condition or in a not clean (e.g., not disinfected, red light) condition. The two lights are controlled by a control circuit (not shown in FIG. 1) based on (a) information derived from an ethanol sensor 16 in the badge, (b) signals from a timer (also not shown in FIG. 1) that tracks the passage of time after the circuit has determined that the hands are likely to be in a disinfected condition, and (c) the state of the logic implemented by the control circuit (also not shown). An LCD display 23 provides displayed information that can include the status of the badge, the control circuit, or the sensor; the time; the status of the cleanliness of the doctor's hands; and other information.

In addition to providing the disinfection determining function, the badge 10 can be of a shape and form and can display information sufficient to serve a conventional function of complying with government and institution regulations that require health care workers to carry visible identification. For example, the badge includes a photograph 17 of the doctor, and other information including the doctor's name 19 and identification number 21. A typical badge could be approximately credit-card size.

Because health care workers are required to carry such badges for other reasons, providing the disinfection determining function within the same badge make it more likely that the worker will use that function than if the function were provided in a separate device that the worker was expected to carry separately. In addition, because the badge worn by a worker must be visible to others in the health care environment, the feature of the badge that indicates whether the user's hands are clean or unclean will naturally be visible to others. Thus, the worker, merely by having to wear the badge, will be subjected to social pressure of peers, patients, and managers with respect to the cleanliness of the worker's hands. This makes the use of the disinfection determining feature of the badge and the improvement of cleanliness habits self-enforcing. The institution by whom the worker is employed need only provide badges that include those features without directly managing or monitoring their use.

A pair of electrodes 24, 26 on either side of the sensor is used to determine when a finger 28 or other part of the hand or other skin has been placed against the sensor. When skin of a finger or other part of the hand touches both electrodes, the resistance between them will decline. By measuring that resistance the control circuit can detect the presence of a finger.

The badge is used by the doctor in conjunction with disinfecting her hands using cleaners of the kind that include ethanol (for example, the liquid known by the name Purell available from GOJO Industries, Akron, Ohio, and which contains 62% ethyl alcohol). Such cleaners are considered to be more effective than soaps and detergents in killing bacteria and viruses and are widely used in health care and other environments. When the ethanol-based cleaner is rubbed on the skin of the hands, the ethanol kills the bacteria and viruses. The effect will last for several hours but eventually wears off. Ethanol is volatile and eventually evaporates from the skin, leaving the possibility (which increases over time) that live bacteria and viruses will again contaminate the skin from the air and from objects that are touched, for example.

The concentration of ethanol on the skin and the decay of that concentration from evaporation tend to determine the onset of subsequent contamination. In turn, the concentration of ethanol on the skin can be inferred by the concentration of ethanol vapor near the skin. By placing the skin near an ethanol detector for a short period of time, it is possible to determine the vapor concentration of ethanol and thus to infer the ethanol concentration on the skin and the disinfected state of the skin. When the current inferred concentration is above a threshold, it is possible to make an assumption about how long the hands will remain disinfected.

The badge can be used in the following way to improve the hand cleaning habits of the user.

In some simple examples, the badge can be configured to determine and display two different states: disinfected and not disinfected.

Except when the badge has recently enough (say within two or three hours) entered the disinfected state due to a measurement cycle in which an adequate concentration of ethanol vapor had been sensed, the badge will assume a default state of the user's skin of not disinfected. Thus, when the badge is first powered on, or reset, or the permitted time since a prior successful measurement has elapsed, the state becomes not disinfected. When the state is not disinfected the red light is lit and the word re-test is displayed on the LCD.

In some implementations, the badge can be made to switch from the not disinfected state to the disinfected state only by a successful ethanol measurement cycle. A successful cycle is one in which a finger or other part of the body is held in position over the sensor (touching both of the electrodes) for a period that is at least as long as a required measurement cycle (e.g., 30 seconds or 45 seconds or 60 seconds depending on the design of the circuit), and the concentration of ethanol vapor that passes from the skin into a measurement chamber of the sensor is high enough to permit an inference that the skin is disinfected.

Thus, when the doctor wipes her hands with the cleaner to disinfect them, she can then press one of her clean fingers against the sensor 16 and the two electrodes 24, 26, for, say, 60 seconds.

Touching of both of the electrodes simultaneously by the finger is detected by the control circuit which then begins the measurement cycle. The control circuit could start the red and green lamps to flash alternately and to continue to do so as an indication to the user that the electrodes are both being touched and that the measurement cycle is proceeding. At the end of the sensing cycle, the control circuit determines a level of concentration of ethanol and uses the level to determine whether the finger, and by inference, the hand of the doctor is disinfected. Each time a measurement cycle has been fully completed, the red and green lights may both be flashed briefly to signal that the cycle has ended and the finger may be removed.

The control circuit continually monitors the electrodes to determine when a finger or other skin is touching both of the electrodes. When that event is detected, a measurement cycle count down timer (which is initialized for the number of seconds needed to complete a measurement) is started. At the beginning of a cycle, a voltage is applied to the heater to begin to heat the sensor element. Initially the heater voltage may be set to a higher than normal value in order to shorten the initial action period described below. Then the heater voltage is reduced. At the end of the measurement cycle, a measurement voltage is applied across the series connection of the measurement cell and the series resistor, and the voltage across the series resistor is detected and compared to a threshold to determine whether the state should be set to disinfected or not disinfected.

When the control circuit determines that the hand is disinfected, the control circuit switches to the disinfected state, lights the green lamp (and turns off the red lamp), and displays the word clean on the LCD. In addition, upon the initiation of the disinfected state, the control circuit starts a re-test count down timer that is initially set to the period during which the skin is expected to remain disinfected (for example two hours).

If the control circuit is in the disinfected state and the user voluntarily performs another successful measurement cycle (for example, if, during the two hours after the prior successful measurement, she disinfects her hands again), the re-test count down timer is reset.

Anyone in the vicinity of the doctor who can see the lights or LCD is made aware of whether, according to the doctor's use of the badge, the doctor's hands are disinfected or not. People who find troubling the indication that a person's hands are not disinfected can complain to the person or to the employer, for example.

During the sensing cycle the doctor must keep her finger against the sensor for at least a certain period of time, say 60 seconds, to give the sensor and the control circuit time to obtain a good reading. If the doctor removes her finger before the end of the period, the control circuit remains in or switches to the not disinfected state and displays the word re-test on the LCD display.

If the doctor holds her finger against the sensor long enough to complete the sensing cycle and the results of the sensing cycle are displayed on the LCD and by lighting either the red light or the green light.

If the sensing cycle ends with a determination that the finger is not disinfected, the doctor can try again to apply enough of the cleaner to her hands to satisfy the circuit and can test the ethanol concentration again. And the cycle can be repeated until the disinfected state is determined.

In addition to causing the green light to be illuminated and the LCD to show clean, successfully completing an ethanol test also causes the control circuit to reset a count down timer (not shown in FIG. 1) to a predetermined period (say, two hours) after which it is assumed that the benefit of the ethanol treatment has worn off and the doctor's hands are no longer disinfected. When the timer times out at the end of the predetermined period, the control circuit turns off the green light, lights the red light, and changes the displayed word from clean to re-test. The red light stays on and the word re-test continues to be displayed until a successful ethanol test is performed by the doctor.

As shown in FIGS. 2, 3, and 4, the badge 10 can be fabricated by assembling three layers.

A bottom layer 29 (shown schematically in FIG. 2) contains a printed circuit 31 and components mounted on the circuit. The components include the sensor element 30 of the sensor, two thin batteries 32, 34, a microprocessor 36 (an example of the control circuit mentioned earlier), a clock 38 (an example of the timer circuit mentioned earlier that can be used both for the measurement count-down timer and for the re-test count-down timer), the two LED lamps 12, 14, and an LCD display device 40. The detailed interconnections of the devices mounted on the bottom layer are not shown in FIG. 2. The control circuit could be, for example, a PIC microcontroller available from Microchip Technology, Inc. of Chandler, Ariz.

A middle layer (shown schematically in FIG. 3) is thicker than the bottom and top layer and provides physical relief for the components mounted on the bottom layer. The patterns shown in FIG. 3 represent cutouts 43 or perforations in the middle layer.

A top layer 50 (shown schematically in FIG. 4) includes a non-perforated and non-printed clear region 52 to permit viewing of the LCD display. Space is left for adding a photograph and other information as show in FIG. 1. A perforated region 54 provides openings for passage of ethanol vapors into the badge and two perforations 56, 58 on opposite sides of the perforated region 54 accept the conductive electrodes that are used to detect the presence of a finger.

As shown in FIG. 5, the arrangement of the three layers in the vicinity of the sensor provides a sensing chamber 56. Ethanol vapors 55 pass from the finger 53 through the holes in perforated region 54 (which is shown as narrower than in FIG. 4) and into the chamber. Within the chamber is a tin oxide sensor element 30 (which includes an integral heater). The sensor element is connected by wire bonded connections 61 to circuit runs 59 on the bottom layer of the badge. The heater heats the vapors within the chamber and sensor element measures the concentration of ethanol.

Tin oxide sensor are small, low cost, and relatively low in power requirements. An example of a tin oxide ethanol sensor is the Model TGS 2620-M available from Figaro USA Inc. of Glenview, Ill., although other sensors available from other vendors could be used.

The sensor includes an integral heater and four connections, two for the sensor element, and two for the heater. By wiring a resistor in series with the element and measuring the voltage drop across the resistor, the control circuit can determine the amount of current flowing in the element and hence the resistance of the element which will vary with ethanol concentration.

Tin oxide sensors with heaters are subject to a so-called initial action that occurs when the sensors are not energized for a period and then are energized. The resistance of the sensor drops sharply during an initial period of energization, whether gases are present in the surrounding air or not. The longer the period of unenergized storage (up to about 30 days), the longer the period of the initial action. Therefore using tin oxide sensors in the badges requires a trade off between powering their operation for a period longer than the initial action but not so long that the energy drain caused by measurement cycles reduces the lifetime of the battery to an unacceptably short period. Experiments suggest that if the user keeps her finger in contact with the sensor for at least 20 or 30 seconds, the sensing of ethanol then begins to dominate the initial action and permits detection of the ethanol concentration. Other approaches may provide a shorter initial action (such as applying a larger voltage for the first few sections of operation and then the normal voltage after that).

The badge provides a simple, effective, portable, inexpensive way to confirm that the ethanol treatment has occurred no longer than, say, two hours ago, which likely means that the hands remain disinfected. No other external equipment is needed. The disinfection condition is apparent to anyone in the vicinity of the doctor, including patients, supervisors, regulators, and peers. The social pressure associated with being identified easily as not having disinfected hands is an effective way to improve the frequency and thoroughness of cleaning. The system does not force the doctor to comply. Compliance with cleaning rules and policies may remain less than perfect using the badges. Yet it is likely that the compliance will improve significantly. Any degree of improvement translates into reduced costs and injuries now associated with hands that have not been disinfected.

A wide variety of other implementations are within the scope of the following claims.

For example, although a simple matching of a measured ethanol concentration against a threshold can be used to determine simply whether the state should be disinfected or not disinfected, it is also possible to provide a more complicated analysis of measured concentration over time and a comparison of the measured concentration against dynamically selected thresholds.

More than two states would be possible, for example, to denote different levels of disinfection or to denote that longer periods of time may elapse before another measurement is required.

The length of time before a first measurement is considered stale and another measurement is required need not be based on an estimate of how long the ethanol on the skin will be effective, but can be based on an arbitrary period such as every hour.

The degree of accuracy and repeatability of the measurement of ethanol concentration may be traded with the cost and complexity of the circuitry needed to do the measurements. In some examples, the goal need not be to assure that the user's hands are thoroughly disinfected at all times. Rather, if the system encourages more frequent and more thorough cleaning to any noticeable degree, great benefits will result. Thus a very simple system may be quite useful and effective even though it may allow some users to cheat and may fail to determine the state accurately at all times.

Additional lights and displayed words may be used for a variety of purposes. The approach of the end of the disinfected period could be indicated by a yellow light to alert the user that a cleaning would soon be needed.

The lights and LCD display could be supplemented with or replaced by audible alerts for all functions or some of them.

In some examples, not all of the circuitry need be mounted in a single badge. Some of the circuitry could be located in a different piece of equipment. For example, a sensor used in common by many people may be mounted on a wall and convey (say by wireless communication) the measured concentration of ethanol to the badge, which would then determine the state and indicate that state through lights and on the LCD. By separating the two, the badge could be lower cost, the sensor could be more complex and accurate, and the sensor could be located at places where the disinfectant solution is dispensed. Fewer sensors would be needed.

Each badge could itself be split into two components that communicate with each other wirelessly or by wire. For example, a sensor module could be located in the user's pocket, while the badge contains only the logic circuitry.

The cleaning agent that is being measured need not be limited to ethanol but could include combinations of ethanol with other materials or other materials in the absence of ethanol; an appropriate sensor for the other materials would be used.

The badge could include clips, hook and loop fasteners, chains, pins, ribbons, and belt loops, and other devices to hold the badge on the user.

The device need not take the form of a badge but could be an ID device that attaches to a belt, a lapel, any other article of clothing, and other parts of the body including an arm, a leg, or a neck.

The sensor and indicators need not be associated with identification information but could be provided in a device the sole purpose of which is to measure the concentration and provide an indication of it.

The device can be used in non-health care environments in which hand cleanliness is important or expected.

In a health-care environment, the device could be used by anyone who is providing services as well as by patients and their families or friends.

Information about the frequency, timing, and results of measurements performed historically by the user can be stored on the badge.

Many additional functions could be added to the badge by increasing the capacity of its processor, memory, displaying, communications ability, and user inputs features.

The invention claimed is:

1. A method comprising at a device worn by a person in a cleanliness-sensitive environment, electronically detecting at least a threshold concentration of a cleanliness agent on a portion of a person's skin that has been placed in the vicinity of the device, and using light or sound to indicate to people in the vicinity of the person if the portion of the person's skin is not clean, based on the electronic detecting.

2. The method of claim 1 in which the detected concentration is of a vapor of the cleanliness agent.

3. The method of claim 2 in which the vapor is received in a vapor chamber of the device.

4. The method of claim 1 also including indicating if the portion of the person's skin is clean, based on the electronic detecting.

5. The method of claim 1 in which the indication that the person's skin is not clean is based on a passage of time after electronically detecting that the person' skin is clean.

6. The method of claim 1 also including providing from the device an identification of the person by whom the device is worn.

7. An apparatus comprising a device worn by a person in a cleanliness-sensitive environment, the device including an electronic detector to detect at least a threshold concentration of a cleanliness agent on a portion of a person's skin that has been placed in the vicinity of the device, and a light or sound indicator to indicate to people in the vicinity of the person if the portion of the person's skin is not clean, based on the electronic detecting.

8. The apparatus of claim 7 in which the electronic detector comprises an alcohol sensor.

9. The apparatus of claim 7 in which the device also includes a space the person can place the portion of skin to permit the cleanliness agent to reach the detector.

10. The apparatus of claim 7 also including a vapor chamber to receive vapor of the cleanliness agent and enable it to contact the detector.

11. The apparatus of claim 7 in which the detector comprises a heated sensor element.

12. The apparatus of claim 7 also including an element to hold the device on the person.

13. The apparatus of claim 7 also including a circuit to control how long after the threshold concentration has been detected the person's skin is presumed no longer to be clean.

* * * * *

UNITED STATES PATENT AND TRADEMARK OFFICE

CERTIFICATE OF CORRECTION

PATENT NO. : 7,482,936 B2
APPLICATION NO. : 11/876267
DATED : January 27, 2009
INVENTOR(S) : Steven F. Bolling It is certified that error appears in the above-identified patent and that said Letters Patent is hereby corrected as shown below:

Title Page: Insert -- Related U.S. Application Data
(60) Continuation of application no. 11/157,094, filed June 20, 2005, now Pat. No. 7,286,057 --.

Claim 5, Line 3: Delete "person'" and insert -- person's --.

Signed and Sealed this

Thirty-first Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,482,936 B2
APPLICATION NO. : 11/876267
DATED : January 27, 2009
INVENTOR(S) : Steven F. Bolling It is certified that error appears in the above-identified patent and that said Letters Patent is hereby corrected as shown below:

Title Page: Insert -- Related U.S. Application Data
(60) Continuation of application no. 11/157,094, filed June 20, 2005, now Pat. No. 7,286,057 --.

Column 8, Claim 5, Line 8: Delete "person'" and insert -- person's --.

This certificate supersedes the Certificate of Correction issued March 31, 2009.

Signed and Sealed this

Twenty-first Day of April, 2009

John Doll

JOHN DOLL
*Acting Director of the United States Patent and Trademark Office*